US005262378A

United States Patent [19]

Kung et al.

[11] Patent Number: 5,262,378

[45] Date of Patent: Nov. 16, 1993

[54] THERMAL DYE TRANSFER RECEIVING ELEMENT WITH MISCIBLE POLYCARBONATE BLENDS FOR DYE IMAGE-RECEIVING LAYER

[75] Inventors: Teh-Ming Kung; Thomas W. Martin, both of Rochester; Cheryl L. Warner, Brockport, all of N.Y.

[73] Assignee: Eastman Kodak Company, Rochester, N.Y.

[21] Appl. No.: 995,445

[22] Filed: Dec. 23, 1992

[51] Int. Cl.[5] ..... B41M 5/035; B41M 5/38

[52] U.S. Cl. ..... 503/227; 428/195; 428/412; 428/913; 428/914

[58] Field of Search ..... 8/471; 428/195, 412, 428/913, 914; 503/227

[56] References Cited

U.S. PATENT DOCUMENTS

| | | | |
|---|---|---|---|
| 4,695,286 | 9/1987 | Vanier et al. | 8/471 |
| 4,740,497 | 4/1988 | Harrison et al. | 503/227 |
| 4,927,803 | 5/1990 | Bailey et al. | 503/227 |
| 5,011,814 | 4/1991 | Harrison | 503/227 |
| 5,096,875 | 3/1992 | Martin | 503/227 |

*Primary Examiner*—B. Hamilton Hess

*Attorney, Agent, or Firm*—Andrew J. Anderson

[57] ABSTRACT

A dye-receiving element for thermal dye transfer includes a support having on one side thereof a dye image-receiving layer. Receiving elements of the invention are characterized in that the dye image-receiving layer comprises a miscible blend of an unmodified bisphenol-A polycarbonate and a polyether modified polycarbonate, the polyether modified polycarbonate being a block copolymer of polyether block units and bisphenol-A polycarbonate block units.

20 Claims, No Drawings

THERMAL DYE TRANSFER RECEIVING ELEMENT WITH MISCIBLE POLYCARBONATE BLENDS FOR DYE IMAGE-RECEIVING LAYER

This invention relates to dye-receiving elements used in thermal dye transfer, and more particularly to the use of miscible polycarbonate blends in the dye image-receiving layers for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye receiving elements used in thermal dye transfer generally include a support (transparent or reflective) bearing on one side thereof a dye image-receiving layer. The dye image-receiving layer conventionally comprises a polymeric material chosen from a wide assortment of compositions for its compatibility and receptivity for the dyes to be transferred from the dye donor element.

Polycarbonates have been found to be desirable image-receiving layer polymers because of their effective dye compatibility and receptivity. As set forth in U.S. Pat. No. 4,695,286, bisphenol-A polycarbonates of number average molecular weights of at least about 25,000 have been found to be especially desirable in that they also minimize surface deformation which may occur during thermal printing. These polycarbonates, however, do not always achieve dye transfer densities as high as may be desired, and their stability to light fading may be inadequate. U.S. Pat. No. 4,927,803 discloses that modified bisphenol-A polycarbonates obtained by co-polymerizing bisphenol-A units with linear aliphatic diols may provide increased stability to light fading compared to ummodified polycarbonates. Such modified polycarbonates, however, are relatively expensive to manufacture compared to the readily available bisphenol-A polycarbonates.

Polymers may be blended for use in the dye-receiving layer in order to obtain the advantages of the individual polymers and optimize the combined effects. For example, relatively inexpensive unmodified bisphenol-A polycarbonates of the type described in U.S. Pat. No. 4,695,286 may be blended with the modified polycarbonates of the type described in U.S. Pat. No. 4,927,803 in order to obtain a receiving layer of intermediate cost having both improved resistance to surface deformation which may occur during thermal printing and to light fading which may occur after printing. A problem with such polymer blends, however, results if the polymers are not completely miscible with each other, as such blends may exhibit a certain amount of haze. While haze is generally undesirable, it is especially detrimental for transparency receivers. Also, blends which are not completely compatible may result in poorer image dye dark stability, and suffer from performance variation due to their metastable nature.

Fingerprint resistance is another desirable property for image-receiving layer polymers, since fingerprints present a potential image stability problem with thermal dye transfer images. Contaminants from fingerprints may attack the dyes and, therefore, degrade the image. The result is often a dye density loss due to crystallization.

Retransfer is another potential image stability problem with thermal dye transfer images. The receiver must act as a medium for dye diffusion at elevated temperatures, yet the transferred image dye must not be allowed to migrate from the final print. Retransfer is observed when another surface comes into contact with a final print. Such surfaces may include paper, plastics, binders, backside of (stacked) prints, and some album materials.

Further, with the advent of more compact high-speed thermal printers, it becomes desirable to design thermal print media for greatly shortened printer line times and reduced loads of the thermal print head. It is necessary that the print media for these newer machines preferably be free of haze and perform at lower power levels of the thermal print head.

Accordingly, it would be highly desirable to provide a receiver element for thermal dye transfer processes with a dye image receiving layer comprising a polymer blend having excellent dye uptake and image dye stability, and which was essentially free from haze. It would be further desirable to provide such a receiver having improved fingerprint resistance and retransfer resistance.

These and other objects are achieved in accordance with this invention which comprises a dye-receiving element for thermal dye transfer comprising a support having on one side thereof a dye image-receiving layer, wherein the dye image-receiving layer comprises a miscible blend of an unmodified bisphenol-A polycarbonate and a polyether modified polycarbonate, the polyether modified polycarbonate being a block copolymer of polyether block units and bisphenol-A polycarbonate block units.

The polyether block units may be formed from linear aliphatic diols having from 2 to about 10 carbon atoms, and are preferably formed from ethylene glycol. In a preferred embodiment of the invention, the polyether block units have a number molecular weight of from about 4,000 to about 50,000, and the bisphenol-A polycarbonate block units have a number molecular weight of from about 15,000 to about 250,000. The over-all molecular weight of the block copolymer is preferably from about 30,000 to about 300,000.

In another preferred embodiment of the invention, the unmodified bisphenol-A polycarbonate has a number molecular weight of at least about 25,000.

In a further preferred embodiment of the invention, the unmodified bisphenol-A polycarbonate and the polyether modified polycarbonate polymers are blended at a weight ratio of from 80:20 to 10:90. For enhanced resistance to fingerprints, weight ratios of from about 50:50 to about 40:60 are particularly preferred.

Preferred modified polycarbonate for use in receiving layer blends of the invention are represented by the formula:

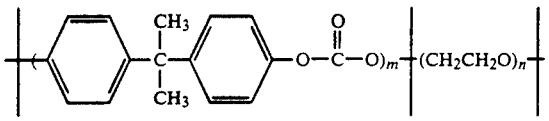

where m is from about 60 to 1,000, more preferably 100 to 300, and n is from about 90 to 1,000, more preferably 100 to 300. A particularly preferred polyether-modified bisphenol-A polycarbonate block co-polymer which may be used in the receiving layer blend is Makrolon KL3-1013, available from Bayer AG, where m is approximately 180 and n is approximately 120.

Examples of unmodified bisphenol-A polycarbonates include LEXAN 141-112 (General Electric Co.) and Makrolon 5700 (Miles Labs).

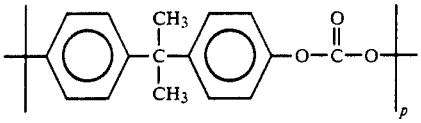

Lexan 141-112: p ~ 120
Makrolon 5700: p ~ 280

The support for the dye-receiving element of the invention may be transparent or reflective, and may comprise a polymeric, a synthetic paper, or a cellulosic paper support, or laminates thereof. Examples of transparent supports include films of poly(ether sulfone)s, polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference.

The dye image-receiving layer may be present in any amount which is effective for its intended purpose. In general, good results have been obtained at a receiver layer concentration of from about 0.5 to about 10 g/m$^2$.

Resistance to sticking during thermal printing may be enhanced by the addition of release agents to the dye receiving layer or to an overcoat layer, such as silicone based compounds, as is conventional in the art.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye donor element and transferring a dye image to a dye-receiving element as described above to form the dye transfer image.

In a preferred embodiment of the invention, a dye donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

A clear solution was prepared by dissolving polyether modified bisphenol-A polycarbonate block copolymer Makrolon KL3-1013 (Bayer AG) and unmodified bisphenol-A polycarbonate Makrolon 5700 (Miles Labs) in methylene chloride at a weight ratio of 1:1 and at a final total solids content of 8 wt. %. This solution was coated on a transparent, 100 μm thick poly(ethylene terephthalate) support (PET) using a 100 μm doctor blade. The coating block temperature was controlled at 32.2° to 35.0° C. A visually transparent film was obtained which was further dried in an oven at 70° C. for half an hour. This polycarbonate blend is referred to below as E-1.

A film of a second polycarbonate blend E-2 was prepared in the same fashion as E-1, except that unmodified bisphenol-A polycarbonate LEXAN 141-112 (General Electric Co.) was used in place of Makrolon 5700. The weight ratio in methylene chloride (1:1) and the final solids content (8%) were the same as those for E-1.

A film of a comparison polycarbonate blend C-1 was prepared in the same fashion as E-1, except that a random 50:50 mol % copolymer of bisphenol-A carbonate with diethylene glycol (R-1) was used in place of the Makrolon KL3-1013 block copolymer:

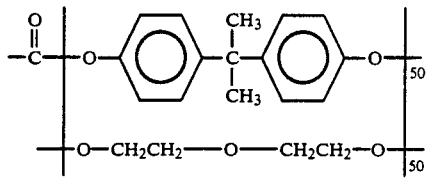

R-1: 4,4'-isopropylidene-bisphenol-co-2,2'-oxydiethanol polycarbonate (50:50) random copolymer The degree of haze was determined for the three films according to the standard ASTM procedure (Test Method D1003), using an XL-211 Hazemeter (available from Pacific Scientific Co.). The readings are shown below in Table I (the higher the reading, the more pronounced the haze of the tested material):

TABLE I

| Material Used | E-1 on PET support | E-2 on PET suppport | C-1 on PET support | Uncoated PET support |
|---|---|---|---|---|
| Haze Reading | 1.5 | 1.7 | 11.5 | 1.6 |

The above data show that both the KL3-1013/Makrolon 5700 blend (E-1) and the KL3-1013/LEXAN 141 blend (E-2) are compatible systems forming transparent, thin films free of haziness. The incompatible blend (C-1) exhibits a very pronounced degree of haziness.

EXAMPLE 2

Completely compatible polymeric blends usually show only one glass transition temperature, Tg, whereas noncompatible systems will exhibit the Tg's of the individual polymers making up the blend. To confirm the miscibility of the blends of the invention, the materials set forth in Table II were coated on polyethylene-resin coated paper support under the same coating and drying conditions as described in Example 1, peeled off from the support, and then subjected to analysis by a differential scanning colorimeter (Perkin-Elmer Model DSC-1). The glass transition data obtained are shown in Table II below.

TABLE II

| Material | $T_g$ (°C.) |
|---|---|
| E-1 | 124 |
| C-1 | 67 and 151 |
| KL3-1013 | 60–80* |
| R-1 | 69 |
| Makrolon 5700 | 157 |

*Indicates one broad transition between values indicated.

EXAMPLE 3

Dye receiving elements were prepared using paper stock overcoated on both sides with $TiO_2$-pigmented polyethylene as a support. The following back coating was applied to one side of this support:

| | |
|---|---|
| Colloids 7190-25 (Colloids Industry) polyvinyl alcohol | 0.068 g/m$^2$ |
| Ludox AM (DuPont) colloidal silica | 0.65 g/m$^2$ |
| Polystyrene beads (avge. diam. 12 μm) | 0.22 g/m$^2$ |
| Polyox WSRN-10 (Union Carbide) (a poly(ethylene oxide) of MW 100,000) | 0.067 g/m$^2$ |
| Triton X200E (Rohm & Haas) (a sulfonated aromatic-aliphatic surfactant) | 0.019 g/m$^2$ |
| Daxad 30 (W. R. Grace & Co.) (sodium polymethacrylate) | 0.019 g/m$^2$ |

The other side of the support was subjected to corona discharge treatment and then coated as follows: the subbing material used was DOW Z6020 (a silane coupling agent of Dow Chemical Co.), prepared by diluting the original material with 3A alcohol and 1% water. This coating solution was applied to the above support at a coverage of 0.11 g/m$^2$. Onto this subbing layer a dye-receiving layer comprising KL3-1013 (1.62 g/m$^2$) and Makrolon 5700 (1.62 g/m$^2$) (polycarbonate blend E-1), dibutyl phthalate (0.32 g/m$^2$), diphenyl phthalate (0.32 g/m2), and Fluorad FC-431 (a perfluorosulfonamido surfactant available from 3M Co.) (0.11 g/m$^2$) was coated from a methylene chloride and trichloroethylene solvent mixture. Finally, a receiver overcoat of a polycarbonate random terpolymer of bisphenol-A (50 mole %), diethylene glycol (49 mole%), and 2,500 MW poly-dimethylsiloxane block units (1 mole %) (0.22 g/m$^2$), Fluorad FC-431 (3M Corp.) (0.012 g/m$^2$), and Dow Corning 510 Silicone Fluid (mixture of dimethyl and methylphenyl siloxanes) (0.005 g/m$^2$) was coated from a solvent mixture of methylene chloride and trichloroethylene. Receiving elements were also prepared using polycarbonate blends E-2 and C-1 described in Example 1 in place of blend E-1. The resultant multilayer dye-receiver elements were then subjected to thermal dye transfer printing with a dye donor as dye source and a thermal print head as heat source.

A dye donor element of sequential areas of cyan, magenta and yellow dye was prepared by coating the following layers in order on a 6 μm poly(ethylene terephthalate) support:

(1) Subbing layer of Tyzor TBT (titanium tetra-n-butoxide) (duPont Co.) (0.12 g/m2) from a n-propyl acetate and 1-butanol solvent mixture.

(2) Dye-layer containing a mixture of Cyan Dye 1 (0.37 g/m$^2$) and Cyan Dye 2 (0.11 g/m$^2$) illustrated below, a mixture of Magenta Dye 1 (0.14 g/m$^2$) and Magenta Dye 2 (0.15 g/m$^2$) illustrated below, or Yellow Dye 1 illustrated below (0.26 g/m$^2$) and S-363N1 (a micronized blend of polyethylene, polypropylene and oxidized polyethylene particles) (Shamrock Technologies, Inc.) (0.02 g/m$^2$) in a cellulose acetate propionate binder (2.5% acetyl, 45% propionyl) (0.30–0.40 g/m$^2$) from a toluene, methanol, and cyclopentanone solvent mixture.

On the reverse side of the support was coated:

(1) Subbing layer of Tyzor TBT (0.12 gm/m$^2$) from a n-propyl acetate and 1-butanol solvent mixture.

(2) Adhesion layer of cellulose acetate propionate (2.5% acetyl, 45% propionyl) (0.11 g/m$^2$) coated from a toluene, methanol and cyclopentanone solvent mixture.

(3) Slipping layer of cellulose acetate propionate (2.5% acetyl, 45% propionyl) (0.532 g/m$^2$), PS-513

(an aminopropyl dimethyl terminated polydimethylsiloxane) (Huls America, Inc.) (0.011 g/m$^2$), p-toluene sulfonic acid (5% in methanol) (0.003 1 g/m$^2$), and Candelilla wax particles (Strahl and Pitsch) (0.021 g/m$^2$) coated from a toluene, methanol and cyclopentanone solvent mixture.

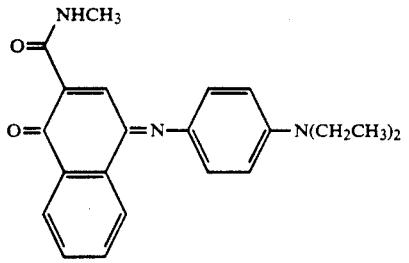

(Cyan Dye 1)

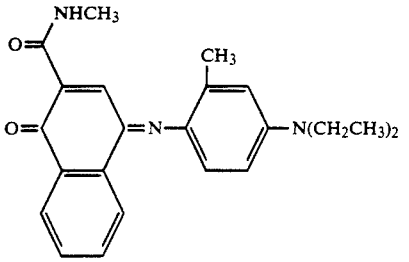

(Cyan Dye 2)

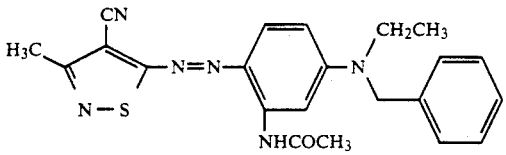

(Magenta Dye 1)

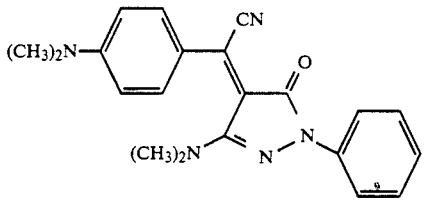

(Magenta Dye 2)

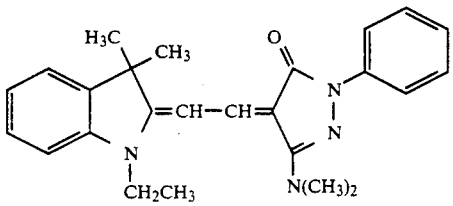

(Yellow Dye 1)

The dye side of the dye-donor element approximately 10 cm×13 cm in area was placed in contact with the polymeric receiving layer side of the dye-receiver element of the same area. The assemblage was fastened to the top of a stepper motor-driven 53 mm diameter rubber roller, and a TDK Thermal Head L-231 was pressed with a force of approximately 23 Newtons (2.3 kg) against the dye-donor element side of the assemblage pushing it against the rubber roller.

The imaging electronics were activated and the assemblage was drawn between the printing head and roller at 26.2 mm/sec. Coincidentally, the resistive elements in the thermal print head were pulsed in a determined pattern for 29 μsec/pulse at 128 μsec intervals during the 8.2 msec/dot line printing time to create an image. A stepped density image was generated by incrementally increasing the number of pulses/dot from 0 to 63. The voltage supplied to the print head was approximately 12.7 volts, resulting in an instantaneous peak power of 0.313 watts/dot and a maximum total energy of 2.5 mjoules/dot. The temperature of the print head was maintained at 30° C. between printings.

Stepped individual cyan, magenta and yellow images were obtained by printing from three dye-donor patches. When properly registered a full color image was formed. The Status A red, green, and blue reflection densities of the stepped density images were read and recorded.

The imaged receivers were then tested for their storage stability by keeping them in the dark at 50° C. and 50% relative humidity for 7 days. The Status A red, green, and blue reflection densities before and after keeping were then compared for the step of each dye image which had an initial optical density nearest to 1.0, and the percent density loss was calculated. The receivers were also visually examined for signs of dye crystallization. The results are presented in Table III.

TABLE III

| | Percent Density Loss | | | Observed Cyan Dye |
|---|---|---|---|---|
| MATERIAL* | CYAN | MAGENTA | YELLOW | Crystallization |
| C-1 | 19% | 2% | 3% | gross crystallization |
| E-1 | 2 | 1 | 1 | trace crystallization |
| E-2 | 3 | 1 | 2 | no crystallization |

*with addenda as described.

The above results indicate superior dye stability in terms of dye fading and crystallization using the compatible polymer blends of the invention.

EXAMPLE 4

A fingerprint test was performed by applying the fingerprint of a thumb covered with Veriderm oil (Product 936Fu, no perfume, from Upjohn Co.) through a 1 cm$^2$ square cut out from polyethylene coated paper stock, onto a 1.0 density (Status A) neutral patch (obtained by superimposed images from cyan, magenta, and yellow donor patches printed onto receivers as described in Example 3). These fingerprinted, neutral patches were then subjected to 50° C. and 50% RH storage for one week. The Status A red, green, and blue reflection densities before and after keeping were then compared, and the percent density loss was calculated. The results are presented in Table IV.

TABLE IV

| BLEND* | Percent Density Loss | | |
|---|---|---|---|
| | CYAN | MAGENTA | YELLOW |
| C-1 | 28.71% | 18.28% | 20.00% |
| E-1 (60:40)** | 7.37 | 8.24 | 3.53 |
| E-2 | 15.53 | 10.00 | 9.2 |
| E-2 (55:45)** | 8.49 | 5.26 | 4.35 |
| E-2 (60:40)** | 10.58 | 7.78 | 2.25 |

*With addenda as described in Example 3.
**The first figure in this wt. % ratio refers to KL3-1013.

The receivers comprising compatible polycarbonate blends according to the invention (including variations in the percentage compositions of E-1 and E-2 as shown in parentheses) exhibited a considerably reduced loss in dye density in comparison with the control C-1.

EXAMPLE 5

A dye retransfer test was performed by placing the backside of a non-imaged receiver material in direct contact with the image side of an imaged receiver obtained as described in Example 3. This assemblage was placed into a heat-seal bag under a 1 kg aluminum block and kept at 50° C. and 50% relative humidity for 7 days. The optical densities of the image dyes, i.e., cyan, magenta, and yellow, were measured at their Dmax (ca. 2.5) before and after the retransfer test. Table V shows for each dye at its Dmax the density loss due to retransfer to the backside of a non-imaged receiver.

TABLE V

| BLEND* | Percent Density Loss | | |
|---|---|---|---|
| | CYAN | MAGENTA | YELLOW |
| C-1 | 19% | 14% | 28% |
| E-2 | 7% | 10% | 25% |

*with addenda as described.

The receiver comprising a compatible polycarbonate blend according to the invention exhibited a considerably reduced loss in dye density due to retransfer in comparison with the control C-1.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer, wherein the dye image-receiving layer comprises a miscible blend of an unmodified bisphenol-A polycarbonate and a polyether modified polycarbonate, the polyether modified polycarbonate being a block copolymer of polyether block units and bisphenol-A polycarbonate block units.

2. The element of claim 1, wherein the polyether block units have a number molecular weight of from about 4,000 to about 50,000.

3. The element of claim 1, wherein the bisphenol-A polycarbonate block units have a number molecular weight of from about 15,000 to about 250,000.

4. The element of claim 1, wherein the unmodified bisphenol-A polycarbonate has a number molecular weight of at least about 25,000.

5. The element of claim 1, wherein the unmodified bisphenol-A polycarbonate and the polyether modified polycarbonate polymers are blended at a weight ratio of from 80:20 to 10:90.

6. The element of claim 1, wherein the unmodified bisphenol-A polycarbonate and the polyether modified polycarbonate polymers are blended at a weight ratio of from 50:50 to 40:60.

7. The element of claim 6, wherein the support is a transparent support.

8. The element of claim 1, wherein the polyether modified polycarbonate is represented by the formula:

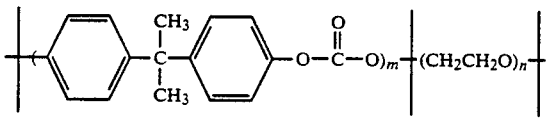

where m is from about 60 to 1,000 and n is from about 90 to 1,000.

9. The element of claim 1, wherein the support is a transparent support.

10. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, wherein the dye image-receiving layer comprises a miscible blend of an unmodified bisphenol-A polycarbonate and a polyether modified polycarbonate, the polyether modified polycarbonate being a block copolymer of polyether block units and bisphenol-A polycarbonate block units.

11. The process of claim 10, wherein the unmodified bisphenol-A polycarbonate and the polyether modified polycarbonate polymers are blended at a weight ratio of from 80:20 to 10:90.

12. The process of claim 10, wherein the unmodified bisphenol-A polycarbonate and the polyether modified polycarbonate polymers are blended at a weight ratio of from 50:50 to 40:60.

13. The process of claim 12, wherein the support is a transparent support.

14. The process of claim 10, wherein the polyether modified polycarbonate is represented by the formula:

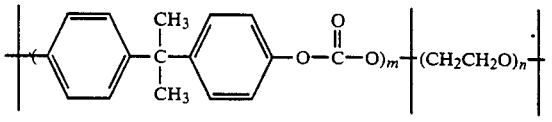

where m is from about 60 to 1,000 and n is from about 90 to 1,000.

15. The process of claim 10, wherein the support is a transparent support.

16. A thermal dye transfer assemblage comprising: (a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein the dye image-receiving layer comprises a miscible blend of an unmodified bisphenol-A polycarbonate and a polyether modified polycarbonate, the polyether modified polycarbonate being a block copolymer of polyether block units and bisphenol-a polycarbonate block units.

17. The assemblage of claim 16, wherein the unmodified bisphenol-A polycarbonate and the polyether modified polycarbonate polymers are blended at a weight ratio of from 50:50 to 40:60.

18. The assemblage of claim 17, wherein the support is a transparent support.

19. The assemblage of claim 16, wherein the polyether modified polycarbonate is represented by the formula:

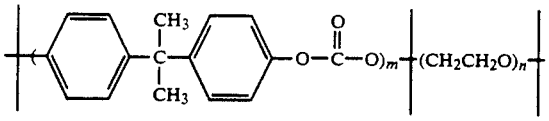

where m is from about 60 to 1,000 and n is from about 90 to 1,000.

20. The assemblage of claim 16, wherein the support is a transparent support.

* * * * *